US006845643B2

(12) United States Patent
Tsai

(10) Patent No.: US 6,845,643 B2
(45) Date of Patent: Jan. 25, 2005

(54) COMBINATION LOCK

(76) Inventor: Cheng-Che Tsai, 10F-5, No. 6, Lane 136, Wen Shian St., Yung Kang City, Tainan (TW)

( * ) Notice: Subject to any disclaimer, the term of this patent is extended or adjusted under 35 U.S.C. 154(b) by 0 days.

(21) Appl. No.: 10/601,155

(22) Filed: Jun. 20, 2003

(65) Prior Publication Data

US 2004/0079122 A1 Apr. 29, 2004

Related U.S. Application Data

(63) Continuation-in-part of application No. 10/279,526, filed on Oct. 24, 2002, now abandoned.

(51) Int. Cl.[7] ..... E05B 37/02

(52) U.S. Cl. ..... 70/312; 70/26; 70/30; 70/315

(58) Field of Search ..... 70/26, 30, 312–319, 70/323–328

(56) References Cited

U.S. PATENT DOCUMENTS 1,510,635 A * 10/1924 Strmic ..... 70/30
2,468,967 A * 5/1949 Fisher ..... 70/295
4,354,365 A * 10/1982 Mayer et al. ..... 70/30
4,719,776 A * 1/1988 Molnar ..... 70/312
5,027,623 A * 7/1991 Ling ..... 70/26
5,050,410 A * 9/1991 Claar et al. ..... 70/237
5,406,811 A * 4/1995 Nakai ..... 70/26
5,636,539 A * 6/1997 Tsai ..... 70/315
5,653,136 A * 8/1997 Huang ..... 70/312
5,899,099 A * 5/1999 Tsai ..... 70/26
5,924,313 A * 7/1999 Kuo ..... 70/26
5,934,120 A * 8/1999 Kuo ..... 70/312
6,058,744 A * 5/2000 Ling ..... 70/28
6,209,368 B1 * 4/2001 Lee ..... 70/312
6,386,005 B1 * 5/2002 Kuo ..... 70/28
6,422,051 B1 * 7/2002 Kuo ..... 70/312
2002/0104337 A1 * 8/2002 Kuo ..... 70/30

* cited by examiner

*Primary Examiner*—Suzanne Dino Barrett
(74) *Attorney, Agent, or Firm*—Alan D. Kamrath; Nikolai & Mersereau, P.A.

(57) ABSTRACT

An inverted U-shaped combination lock is disclosed. The lock includes a male locking mechanisms, a push ring, a hollow spindle, a sealing ring, an abutment ring, number rings, and a spring. The lock can be opened without a password by inserting a key into a keyhole prior to turning an angle of 90 degrees of the key. A ridged section of the mechanism is changed from a higher position to a lower one for disengaging the mechanism from the lock for subsequent removal of the mechanism. The lock also provides help for the user to know the forgotten password and resetting the password.

6 Claims, 7 Drawing Sheets

I

III-III

IV-IV

COMBINATION LOCK

CROSS REFERENCE

This application is a continuation-in-part of U.S. application Ser. No. 10/279,526, filed Oct. 24, 2002, now abandoned.

BACKGROUND OF THE INVENTION

1. Field of the Invention

The present invention relates to combination locks and more particularly to such a combination lock which still can be opened even when a password is forgotten.

2. Description of Related Art

Combination locks are well known for many years. One drawback of the prior combination lock is that a user cannot open the combination lock once a password thereof is forgotten. Thus, it is desirable to provide an improved combination lock which still can be opened even when a password is bigot forgotten in order to overcome the above drawback of the prior art.

SUMMARY OF THE INVENTION

It is an object of the present invention to provide an inverted U-shaped combination lock, comprising a male locking mechanism comprising cylindrical first and second collars at both ends, each of the first and the second collars including a cable extending therefrom, a cylindrical cavity, and an aperture on its outer surface; a cylindrical member including a projected shaft at one end thereof, a keyhole at the other end thereof, and an aperture on its outer surface; a ridged section including a plurality of aligned first grooves; a guard including a trough on a bar at one end and an aperture on an outer surface at the other end; and a first pin inserted into the aperture of the second collar, the aperture of the guard, and the aperture of the cylindrical member sequentially for fastening them together in the cylindrical cavity of the second collar wherein the shaft is inserted through the first grooves into the trough; a push ring comprising two opposite projections at one side and first, second, third, and fourth teeth around the other side wherein a gap between two adjacent teeth is disposed at an angle of 45 degrees about an adjacent gap; a hollow spindle comprising a top elongated second groove, a plurality of peripheral risers at one end, two side first recesses adjacent the risers, an arcuate second recess between two risers, a plurality of aligned spaced protuberances on an outer surface, and an aperture on the outer surface adjacent the other end; a sealing ring comprising two opposite interior slots, a spring depressible detent radially extended inside the sealing ring to urge against the spindle, and an interior protrusion on an inner wall moveable in the second recess; an abutment ring received at one end of the sealing ring, the abutment ring including two opposite wells at the other side for permitting the projections to anchor therein after passing the sealing ring a plurality of number rings each comprising a plurality of numerals printed sequentially on its outer surface, a plurality of peripheral indentations on an inner wall, an interior first ring having a tab projected upward to engage with one of the indentations and a valley opposite the tab, an interior second ring, and a resilient section fastened between the first and the second rings; a spring in the cylindrical cavity of the first collar urged against the second ring of the number ring proximate the first collar; and a second pin inserted into the aperture of the first collar and the aperture of the spindle sequentially for fastening them together. The combination lock can be opened without its password by inserting a key into the keyhole prior to turning an angle of 90 degrees of the key. The ridged section is changed from a relatively higher position to a relatively lower one for disengaging the male locking mechanism from the combination lock for subsequent removal of the male locking mechanism. Alignment of the valleys can help the user know the forgotten password The password is adapted to be reset after opening the combination lock by pushing the push ring inward until the detent reaches the second tooth, the projections urge against the abutment ring, and one of the indentations clears from the tab, and turning the number rings. Locking, of the combination lock is done by turning the sealing ring in one direction to cause the detent to reach the third tooth, urging the spring against the push ring for causing the detent to reach the fourth tooth, turning the sealing ring in an opposite direction until the detent reaches the first tooth for positioning, engaging one of the indentations with the tab of each first ring for fastening, and inserting the male locking mechanism through the number rings.

It is another object of the present invention to provide an inverted U-shaped combination lock, comprising a male locking mechanism comprising cylindrical first and second collars at both ends, each of the first and the second collars including a cable extended therefrom, a cylindrical cavity, and an aperture on its outer surface; a cylindrical member including a projected shaft at one end thereof, a keyhole at the other end thereof, and an aperture on its outer surface; a ridged section including a plurality of aligned first grooves; a guard including a trough on a bar at one end and an aperture on an outer surface at the other end; and a first pm inserted into the aperture of the second collar, the aperture of the guard, and the aperture of the cylindrical member sequentially for fastening them together in the cylindrical cavity of the second collar wherein the shaft is inserted through the first grooves into the trough; a push ring comprising two opposite projections at one side and first, second, third, and fourth teeth around the other side wherein a gap between two adjacent teeth is disposed at an angle of 45 degrees about an adjacent gap; a hollow spindle comprising a top elongated second groove, a plurality of peripheral risers at one end, two side first recesses adjacent the risers, an arcuate second recess between two risers, a plurality of aligned spaced protuberances on an outer surface, and an aperture on the outer surface adjacent the other end; a sealing ring comprising two opposite interior slots, a spring depressible detent radially extended inside the sealing ring to urge against the spindle, and an interior protrusion on an inner wall moveable in the second recess; an abutment ring received at one end of the sealing ring, the abutment ring including two opposite wells at the other side for permitting the projections to anchor therein alter passing the sealing ring; a plurality of number rings each comprising a plurality of numerals printed sequentially on its outer surface, a plurality of peripheral indentations on an inner wall, an interior first ring having a tab projected upward to engage with one of the indentations and a valley opposite the tab, an interior second ring, a resilient section fastened between the first and the second rings, and an inner ring; a spring in the cylindrical cavity of the first collar urged against the second ring of the number ring proximate the first collar; and a second pin inserted into the aperture of the first collar and the aperture of the spindle sequentially for fastening them together. The combination lock can be opened without its password by inserting a key into the keyhole prior to turning an angle of 90 degrees of the key. The ridged section is changed from a relatively higher position to a relatively lower one for disengaging the male locking mechanism from the combination lock for subsequent removal of the male locking mechanism. Alignment of the valleys can help the user know the forgotten password. The password is adapted to be reset after opening the combination lock by pushing the push ring inward until the detent reaches the second tooth, the projections urge against the abutment ring, and one of the indentations clears from the tab, and turning the number rings. Locking of the combination lock is done by turning the sealing ring in one direction to cause the detent to reach the third tooth, urging the spring against the push ring for causing the detent to reach the fourth tooth, turning the sealing ring in an opposite direction until the detent reaches the first tooth for positioning, engaging one of the indentations with the tab of each first ring for fastening, and inserting the male locking mechanism through the number rings.

The above and other objects, features and advantages of the present invention will become apparent from the following detailed description taken with the accompanying drawings.

DETAILED DESCRIPTION OF THE PREFERRED EMBODIMENTS

Figure 1:
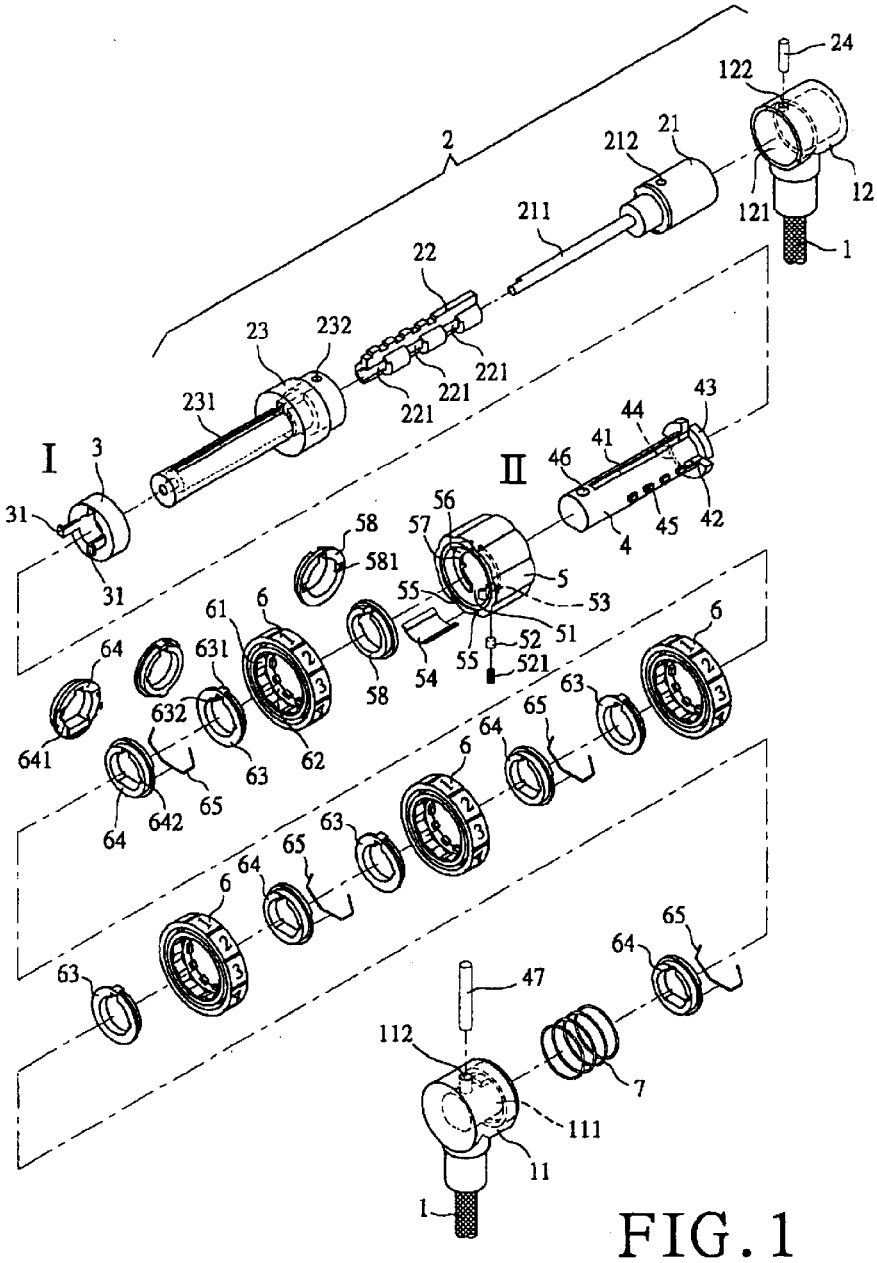
FIG. 1 is an exploded view of a first preferred embodiment of a combination lock according to the invention.
Figure 2:
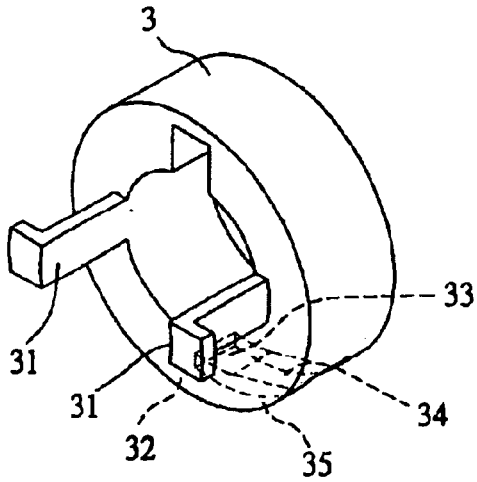
FIG. 2 is a perspective view of I and is a side views in part sections of II shown in FIG. 1.
Figure 2:
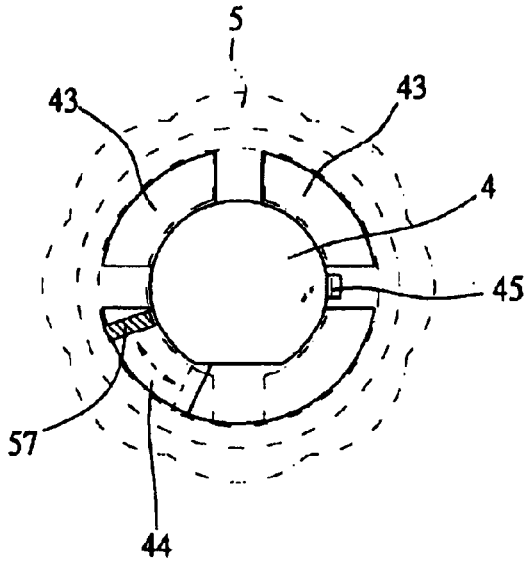
Figure 3:
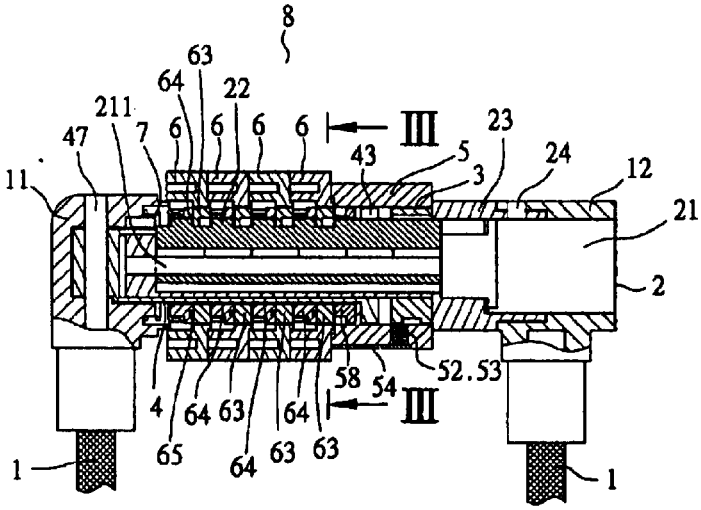
FIG. 3 is a cross-sectional view of the assembled combination lock.
Figure 4:
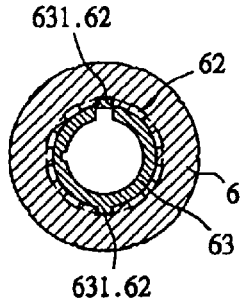
FIG. 4 is a cross-sectional view taken along line III—III of FIG. 3.

Referring to FIGS. 1 to 5 in conjunction with FIGS. 9 to 13, there is shown an inverted U-shaped combination lock 8 constructed in accordance with a first preferred embodiment of the invention. The combination lock 8 comprises a cylindrical first collar 11 and a cylindrical second collar 12 at both ends. Each of the first and the second collars 11 and 12 is attached to a cable or the like 1. A male locking mechanism 2 is attached to a cylindrical cavity 121 of the second collar 12. A cylindrical member 21 comprises a projected shaft 211 at one end inserted through a plurality of aligned grooves 221 of a ridged section 22 into a cut trough 231 of a guard 23. As such, the cylindrical member 21, the ridged section 22, and the guard 23 together have one end held in the cylindrical cavity 121. Moreover, a pin 24 is inserted into an aperture 122 of the second collar 12, an aperture 232 of the guard 23, and an aperture 212 of the cylindrical member 21 sequentially for fastening them together (FIG. 3).

A plurality of number rings (four are shown) 6 are provided. Each number ring 6 has a plurality of numerals (e.g., 0 to 9) printed sequentially on its peripheral surface. A hollow spindle 4 comprises a top elongated groove 41 and two side recesses 42 to allow two opposite projections 31 of a push ring 3 to pass through into two opposite interior slots 51 of a sealing ring 5. Next, turning sealing ring 5 about 90 degrees causes the push ring 3 and the sealing ring 5 to be locked together. Four teeth 32 to 35 are formed around one end of the push ring 3 in which a gap between two adjacent teeth is disposed at an angle of 45 degrees about an adjacent gap. An elastic member 521 is urged against a detent 52 toward an aperture 53 tapered toward the inside of the sealing ring 5 in which the detent 52 is in turn urged against the spindle 4. A peripheral fiat 54 having bent sides is inserted through two parallel indentations 55 to press on an outer end of the elastic member 521 for fastening the detent 52. A plurality of peripheral risers 43 and an arcuate recess 44 are formed at one end of the spindle 4. The recess 44 is adapted to allow an interior protrusion 57 on an inner wall 56 of the sealing ring 5 to move therein. In other words, the protrusion 57 can only move from one end of the recess 44 to the other end thereof or vice versa. A plurality of aligned spaced protuberances 45 are formed on an outer surface of the spindle 4. An abutment ring 58 is formed at the other end of the sealing ring 5. Two opposite wells 581 are provided on an end of the abutment ring 58 for permitting the projections 31 to anchor therein after passing the sealing ring 5. A spring 7 is anchored in a cylindrical cavity ill of the first collar 11. The number ring 6 comprises a cylindrical cavity 62, a first ring 63 received in the cylindrical cavity 61. the first ring 63 having a tooth 631 projected upward to engage with one of a plurality of peripheral indentations 62 inside the number ring 6, a resilient section 65, and a second ring 64 including a recessed portion 641 at one end with the resilient section 65 anchored therein and a raised portion 642 at the other end sandwiched between any two adjacent protuberances 45 and being adapted to anchor the resilient section 65 at the other end. Both the first and the second rings 63 and 64 are anchored inside the number ring 6 (i.e., in the cylindrical cavity 61). One end of the spindle 4 is positioned in the cylindrical cavity 111. Finally, a pin is inserted into an aperture 112 of the first collar 11 and an aperture 46 of the spindle 4 sequentially for fastening them together.

Figure 5:
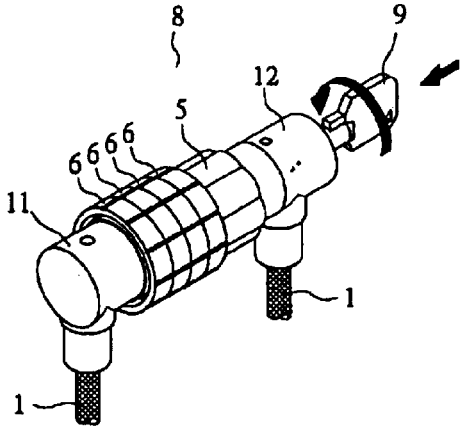
FIG. 5 is an assembled view of the combination lock with a key inserted.
Figure 12:
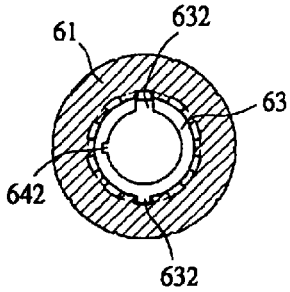
FIG. 12 is a cross-sectional view taken along line IV—IV of FIG. 11.
Figure 13:
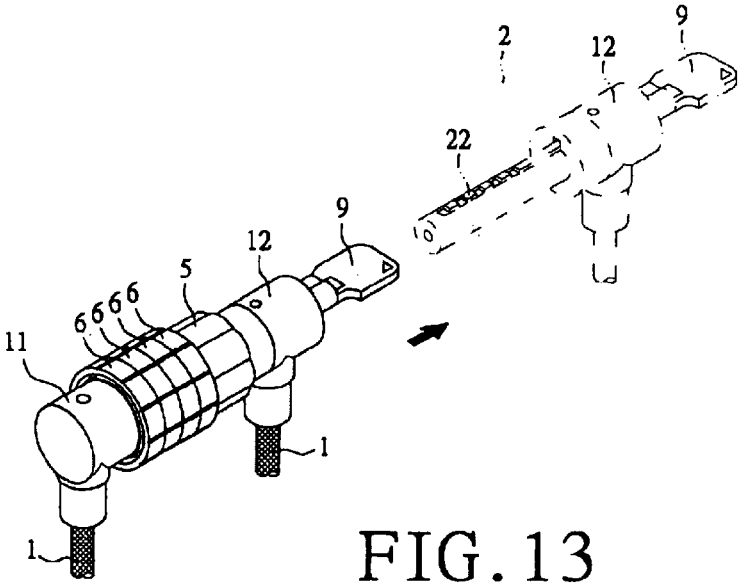
FIG. 13 is a perspective view of the combination lock illustrating removal of the male locking mechanism.

Following is a description of opening the combination lock 8 in a case that a user forgets the password. In FIG. 5, a key 9 is inserted into a keyhole of the cylindrical member 21 prior to turning a predetermined angle (e.g., 90 degrees). As such, the ridged section 22 is changed from a higher position (see FIG. 9) to a lower position (see FIG. 10). As a result, the user can remove the male locking mechanism 2 from the combination lock 8 for opening the combination lock 8 as indicated by phantom lines of FIG. 13. The user then has to align valleys 632 of the first rings 63 by adjusting (FIG. 12). This can help the user know the forgotten password of the combination lock 8.

Following is a description of changing the password of the combination lock 8 after opening it. First, push the push ring 3 inward as indicated by arrow in FIG. 11 until the detent 52 reaches the second tooth 33 and the projections 31 urge against the abutment ring 58. As such, one of the indentations 62 clears from the tooth 631. Next, a user can turn the number rings 6 to reset the password. After finishing the setting, turn the sealing ring 5 to cause the detent 52 to reach the third tooth 34. The spring 7 then is urged against the push ring 3 for causing the detent 52 to reach the fourth tooth 35. Next, turn the sealing ring 5 in an opposite direction until the detent 52 reaches the first tooth 32 for positioning. Again, one of the indentations 62 is engaged with the tooth 631 of each first ring 63 again for fastening. Next, insert the male locking mechanism 2 through the number rings 6. At this time, a user can lock the combination lock 8 again.

Figure 6:
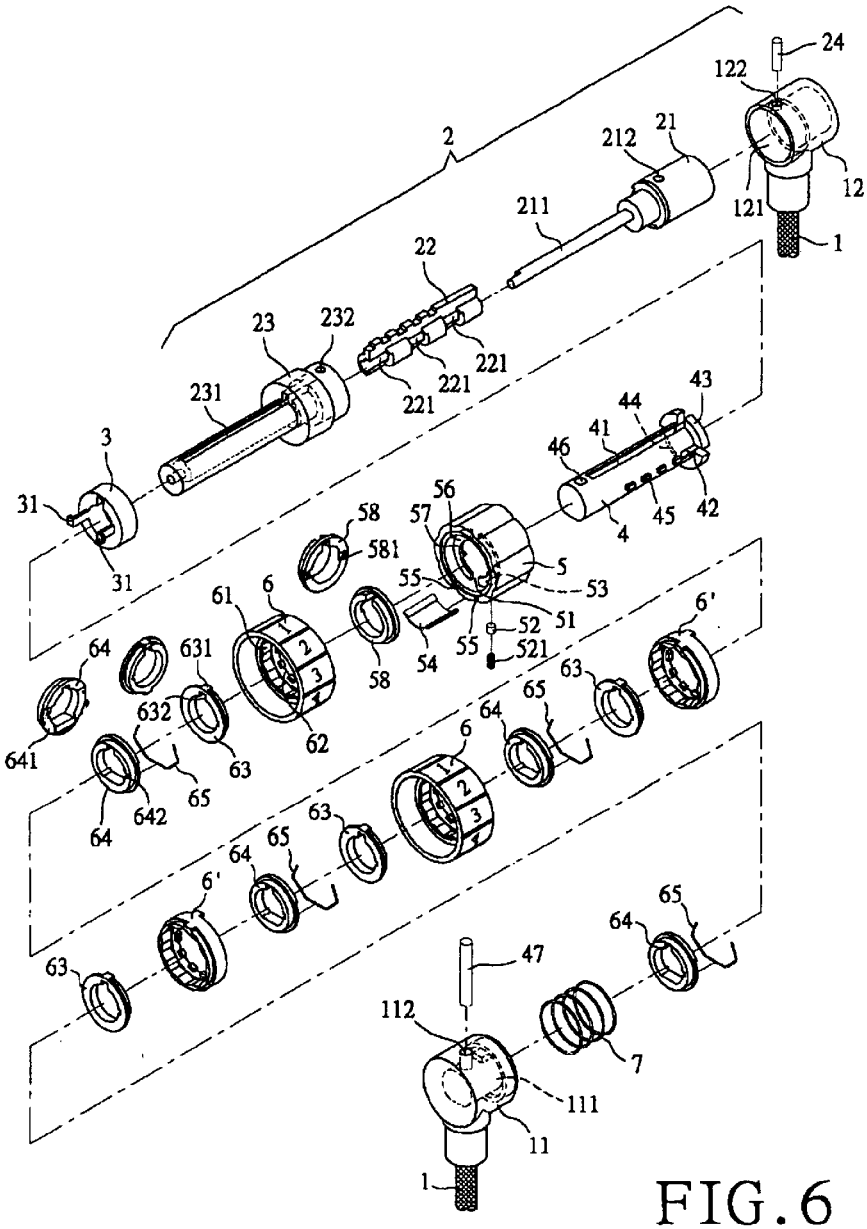
FIG. 6 is an exploded view of a second preferred embodiment of combination lock according to the invention.
Figure 7:
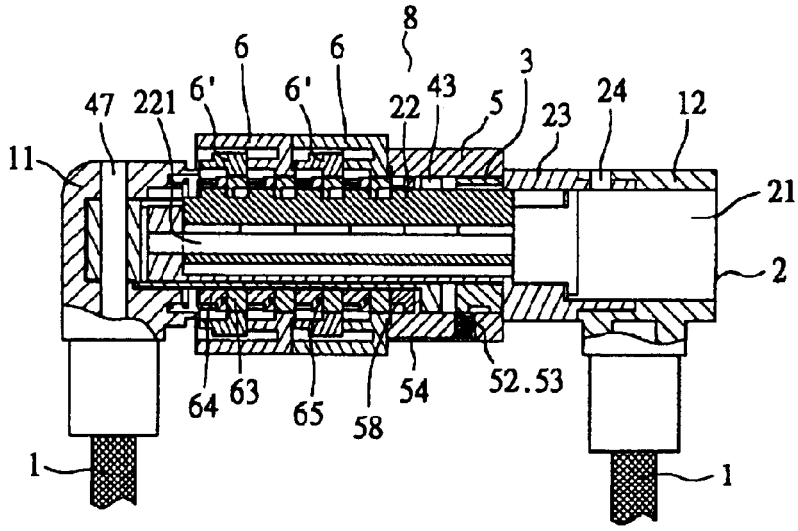
FIG. 7 is a cross-sectional view of the assembled combination lock of FIG. 6.
Figure 8:
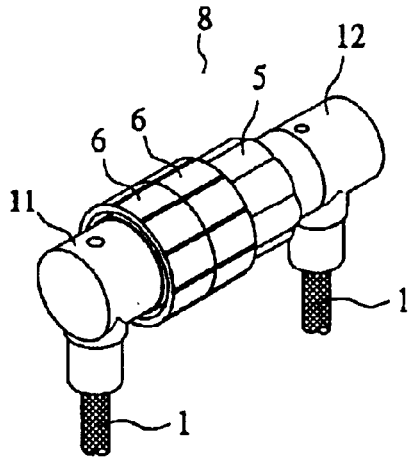
FIG. 8 is an assembled view of the combination lock of FIG. 6.
Figure 9:
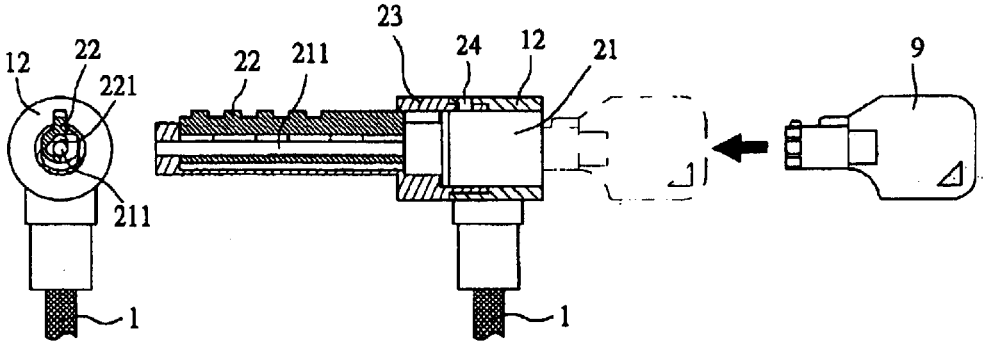
FIG. 9 is a cross-sectional view schematically illustrating a male locking mechanism in a higher position when a key is inserted into but yet turned.
Figure 10:
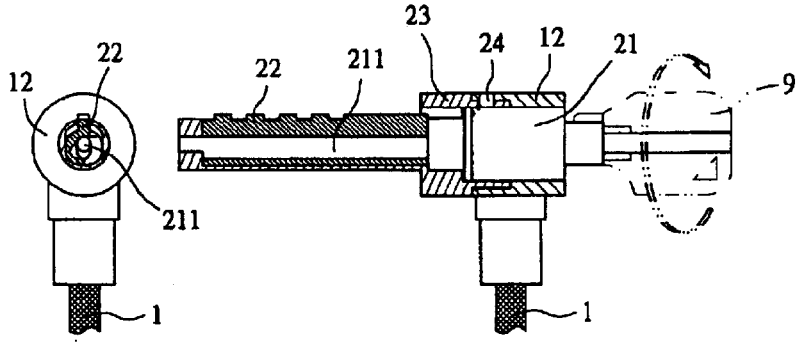
FIG. 10 is a view similar to FIG. 9 where the male locking mechanism is in a lower position when the inserted key has turned.
Figure 11:
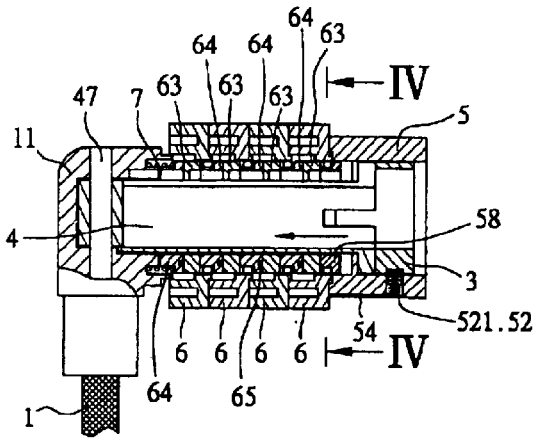
FIG. 11 is a cross-sectional view of the combination lock where the male locking mechanism has been removed.

Referring to FIGS. 6, 7 and 8, a combination lock 8 constructed in accordance with a second preferred embodiment the invention is shown. The second preferred embodiment substantially has same structure as the first preferred embodiment. The differences between the first and the second preferred embodiments, i.e., the characteristics of the second preferred embodiment are detailed below. The number of the number rings 6 is two. Also, an inner ring 6' is provided within the number ring 6 for stabilization purposes.

While the invention herein disclosed has been described by means of specific embodiments, numerous modifications and variations could be made thereto by those skilled in the art without departing from the scope and spirit of the invention set forth in the claims.

What is claimed is:

1. A combination lock having a shape of an inverted U, comprising:

a male locking mechanism comprising cylindrical first and second collars at both ends, each of the first and the second collars including a cable extended therefrom, a cylindrical cavity, and an aperture on its outer surface; a cylindrical member including a projected shaft at one end thereof, a keyhole at the other end thereof, and an aperture on its outer surface; a ridged section including a plurality of aligned first grooves; a guard including a trough on a bar at one end and an aperture on an outer surface at the other end; and a first pin, inserted into the aperture of the second collar, the aperture of the guard, and the aperture of the cylindrical member sequentially for fastening them together in the cylindrical cavity of the second collar wherein the shaft is inserted through the first grooves into the trough;

a push ring comprising two apposite projections at one side and first, second, third, and fourth teeth around the other side wherein a gap between two adjacent teeth is disposed at an angle of 45 degrees about an adjacent gap;

a hollow spindle comprising a top elongated second groove, a plurality of peripheral risers at one end, two side first recesses adjacent the risers, an arcuate second recess between two risers, a plurality of aligned spaced protuberances on an outer surface, and an aperture on the outer surface adjacent the other end;

a sealing ring comprising two opposite interior slots, a spring depressible detent radially extended inside the sealing ring to urge against the spindle, and an interior protrusion on an inner wall moveable in the second recess;

an abutment ring received at one end of the sealing ring, the abutment ring including two opposite wells at the other side for permitting the projections to anchor therein after passing the sealing ring;

a plurality of number rings each comprising a plurality of numerals printed sequentially on its outer surface, a plurality of peripheral indentations on an inner wall, an interior first ring having a tab projected upward to engage with one of the indentations and a valley opposite the tab, an interior second ring, and a resilient section fastened between the first and the second rings;

a spring in the cylindrical cavity of the first collar urged against the second ring of the number ring proximate the first collar; and a second pin inserted into the aperture of the first collar and the aperture of the spindle sequentially for fastening them together, wherein the combination lock can be opened without its password by inserting a key into the keyhole prior to turning an angle of 90 degrees of the key, the ridged section is changed from a relatively higher position to a relatively lower one for disengaging the male locking mechanism from the combination lock for subsequent removal of the male locking mechanism;

an alignment of the valleys can help the user know the forgotten password;

the password is adapted to be reset after opening the combination lock by pushing the push ring inward until the detent reaches the second tooth, the projections urge against the abutment ring, and one of the indentations clears from the tab, and turning the number rings; and locking of the combination lock is done by turning the sealing ring in one direction to cause the detent to reach the third tooth, urging the spring against the push ring for causing the detent to reach the fourth tooth, turning the sealing ring in an opposite direction until the detent reaches the first tooth for positioning, engaging one of the indentations with the tab of each first ring for fastening, and inserting the male locking mechanism through the number rings.

2. The combination lock of claim 1, wherein the number of the number rings is four.

3. The combination lock of claim 1, wherein the numerals on the number ring comprised 0, 1, 2, 3, 4, 5, 6, 7, 8, and 9.

4. A combination lock having a shape of an inverted U, comprising:

a male locking mechanism comprising cylindrical first and second collars at both ends, each of the first and the second collars including a cable extended therefrom, a cylindrical cavity; and an aperture on its outer surface; a cylindrical member including a projected shaft at one end thereof, a keyhole at the other end thereof, and an aperture on its outer surface; a ridged section including a plurality of aligned first grooves; a guard including a trough on a bar at one end and an aperture on an outer surface at the other end; and a first pin inserted into the aperture of the second collar, the aperture of the guard, and the aperture of the cylindrical member sequentially for fastening them together in the cylindrical cavity of the second collar wherein the shaft is inserted through the first grooves into the trough;

a push ring comprising two opposite projections at one side and first, second, third, and fourth teeth around the other side wherein a gap between two adjacent teeth is disposed at an angle of 45 degrees about an adjacent gap;

a hollow spindle comprising a top elongated second groove, a plurality of peripheral risers at one end, two side first recesses adjacent the risers, an arcuate second recess between two risers, a plurality of aligned spaced protuberances on an outer surface, and an aperture on the outer surface adjacent the other end;

a sealing ring comprising two opposite interior slots, a spring depressible detent radially extended inside the sealing ring to urge against the spindle, and an interior protrusion on an inner wall moveable in the second recess;

an abutment ring received at one end of the sealing ring, the abutment ring including two opposite wells at the other side for permitting the projections to anchor therein after passing the sealing ring;

a plurality of number rings each comprising a plurality of numerals printed sequentially on its outer surface, a plurality of peripheral indentations on an inner wall, an interior first ring having a tab projected upward to engage with one of the indentations and a valley opposite the tab, an interior second ring, a resilient section fastened between the first and the second rings, and an inner ring;

a spring in the cylindrical cavity of the first collar urged against the second ring of the number ring proximate the first collar, and a second pin inserted into the aperture of the first collar and the aperture of the spindle sequentially for fastening them together, wherein the combination lock can be opened without its password by inserting a key into the keyhole prior to turning an angle of 90 degrees of the key, the ridged section is changed from a relatively higher position to a relatively lower one for disengaging the male locking mechanism from the combination lock for subsequent removal of the male locking mechanism;

an alignment of the valleys can help the user know the forgotten password;

the password is adapted to be reset after opening the combination lock by pushing the push ring inward until the detent reaches the second tooth, the projections urge against the abutment ring, and one of the indentations clears from the tab, and turning the number rings; and locking of the combination lock is done by turning the sealing ring in one direction to cause the detent to reach the third tooth, urging the spring against the push ring for causing the detent to reach the fourth tooth, turning the sealing ring in an opposite direction until the detent reaches the first tooth for positioning, engaging one of the indentations with the tab of each first ring for fastening, and inserting the male locking mechanism through the number rings.

5. The combination lock of claim 4, wherein the numerals on the number ring comprise 0, 1, 2, 3, 4, 5, 6, 7, 8, and 9.

6. The combination lock of claim 4, wherein the number of the number rings is two.

* * * * *